US005727415A

United States Patent [19]

Alitalo

[11] Patent Number: 5,727,415

[45] Date of Patent: Mar. 17, 1998

[54] FOLDING PRESS WITH HORIZONTAL WORKING STROKE AND ROTATABLE MANIPULATION ARM

[75] Inventor: Hannu Alitalo, Urjala, Finland

[73] Assignee: Aliko Automation Oy, Finland

[21] Appl. No.: 617,756

[22] PCT Filed: Sep. 16, 1994

[86] PCT No.: PCT/FI94/00410

§ 371 Date: Jun. 18, 1996

§ 102(e) Date: Jun. 18, 1996

[87] PCT Pub. No.: WO95/07779

PCT Pub. Date: Mar. 23, 1995

[30] Foreign Application Priority Data

Sep. 16, 1993 [FI] Finland ..... 934069
Sep. 24, 1993 [FI] Finland ..... 934215

[51] Int. Cl.[6] ..... B21D 43/11; B21J 13/08

[52] U.S. Cl. ..... 72/389.3; 72/420; 72/446; 72/422; 901/50; 483/28

[58] Field of Search ..... 72/389.3, 446, 72/422, 420, 421; 483/27, 28, 29; 901/50

[56] References Cited

U.S. PATENT DOCUMENTS 4,991,422 2/1991 Sartorio .
5,182,936 2/1993 Sartorio ..... 72/422
5,187,958 2/1993 Prunotto et al. ..... 72/422
5,345,806 9/1994 Sartorio et al. ..... 72/422
5,366,431 11/1994 Smith et al. ..... 483/29

FOREIGN PATENT DOCUMENTS 392795 10/1990 European Pat. Off. ..... 483/29
6-7851 1/1994 Japan ..... 483/28
500023 1/1971 Switzerland .

*Primary Examiner*—David Jones
*Attorney, Agent, or Firm*—Mathews, Collins, Shepherd & Gould

[57] ABSTRACT

A folding press is disclosed having a frame supported by a fixed base; a fixed beam and a ram beam supported by the frame, the ram beam being movable relative to the fixed beam; a pair of folding blades attached to the beams for folding a sheet of metal; and manipulation means for grasping the sheet of metal and introducing the sheet of metal between the folding blades, the manipulation means being attached to the ram beam. The folding blades are so disposed as to produce a horizontal working stroke relative to the fixed base, and the manipulation means comprises a plurality of arm members rotatable in relation to each other. In operation, the manipulation means grasps a sheet of material and introduces it between the blades while maintaining the sheet of material in a substantially vertical position relative to the fixed base, thereby minimizing folding errors caused by a horizontal disposition of the sheet of material.

6 Claims, 2 Drawing Sheets

FOLDING PRESS WITH HORIZONTAL WORKING STROKE AND ROTATABLE MANIPULATION ARM

Figure 1:
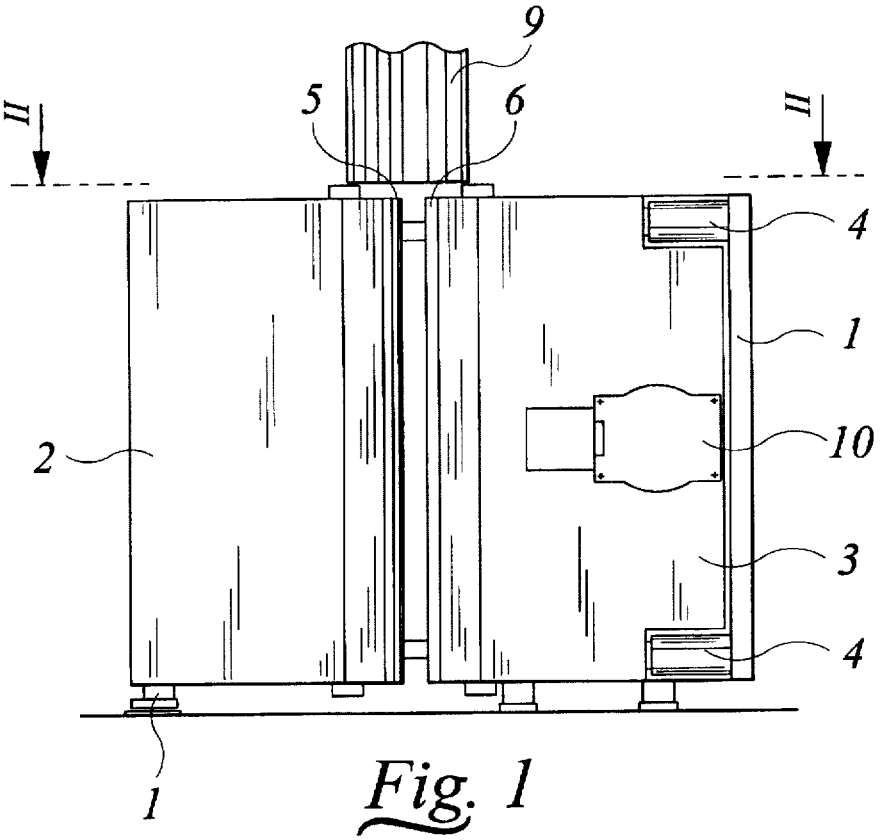

The present invention concerns a folding press.

In prior art folding presses are known comprising a frame; a fixed beam, fixedly connected to the frame; a ram beam supported on the frame to be movable relative to the fixed beam; a force member, disposed between the ram beam and the frame for moving the ram beam relative to the fixed beam in order to accomplish the folding working stroke; a counterblade, attached to the fixed beam; a thrust blade, attached to the ram beam parallelly relative to the counterblade, said counterblade and thrust blade constituting a pair of folding blades between which a piece of metal sheet can be folded; and a multi-articulate manipulation arm such as a robot or the like, comprising a clamping member for grasping the piece of sheet material which is to be folded and inserting it between the pair of folding blades in predetermined manner. In a typical folding press of this type the working stroke of the ram beam is usually vertical, the throat between the blades thus being horizontal.

The problem in the folding press of prior art is that the piece of sheet material to be folded has to be handled and introduced between the pair of folding blades in horizontal position. When the metal sheet is grasped with the clamping member on the manipulation arm and carried in horizontal position into the folding gap between the folding blades, the sheet will bend downward, giving rise to folding errors. The bending of the sheet during the handling step is also problematic for the reason that when programming of the work, i.e., of the functions of folding press and manipulation arm, takes place with the aid of a computer, calculation of the way in which the sheet bends is exceedingly difficult because air resistance, and other circumstances, must be taken into account.

The object of the invention is to eliminate the drawbacks mentioned.

Specifically, the object of the invention is to disclose a folding press in which the piece of sheet metal which is to be folded can be handled with a manipulation arm in such manner that the sheet will not bend down and that folding errors due to this phenomenon will be avoided.

As taught by the invention, the fixed beam and ram beam have been disposed horizontally side by side, the ram beam is guided to be movable substantially in horizontal direction, and the force member is arranged to produce a horizontal working stroke of the ram beam, whereby the piece of sheet material to be folded can be folded while in substantially vertical position between the counterblade and the thrust blade.

The invention affords the advantage that it enables a piece of sheet material to be folded in vertical position, whereby the piece of sheet material will retain its straight vertical position and will not bend, and the folding errors caused hereby are avoided.

In an advantageous embodiment of the folding press the fixed beam with its counterblade and the ram beam with its thrust blade are substantially vertical. The fixed beam and the ram beam are located in a vertical plane and the folding throat, or the gap between the pairs of folding blades, is vertical and opens in lateral direction.

In an advantageous embodiment of the folding press the fixed beam with its counterblade and the ram beam with its thrust blade are substantially horizontal. The fixed beam and ram beam are then in lying position, whereby in one embodiment the folding press may be carried in horizontal position on the structures of the building in which the folding press has been installed, in the height direction at such a distance h from the plane of the floor base that a free space is left below the folding press where one may provide storage space for goods, sojourn and moving spaces for persons, installation space for machines and/or space where vehicles can move. The folding press may in that case constitute a roof-like structure in the upper part of the building, the folding throat opening downward. A folding press in horizontal position may equally be carried on supports close to the floor base of the building in which the folding press is installed, in which case the folding throat opens upward.

In an advantageous embodiment of the folding press the folding press comprises a tool storage for thrust blades and counterblades. The tool storage may be disposed in the vicinity of one end of the pair of folding blades, in which case the tool storage contains thrust blades and counterblades in substantially parallel position relative to their working position on the fixed and ram beams.

In an advantageous embodiment of the folding press the manipulation arm is connected to the ram beam. By placing the manipulation arm, e.g. a piece handling robot, in conjunction with the ram beam one achieves that as the robot travels along with the ram beam, its movement has exactly the right direction because when the sheet bends, the clamping member of the robot will move away from the robot all the time. The ram beam makes a firm fixing base for the robot, and its dimensional accuracy in relation to the blades is well preserved. It is a further advantage that when the manipulation arm is mounted on the ram beam instead of the floor, floor space is left free e.g. for placement of blanks which are going to be folded.

Figure 2:
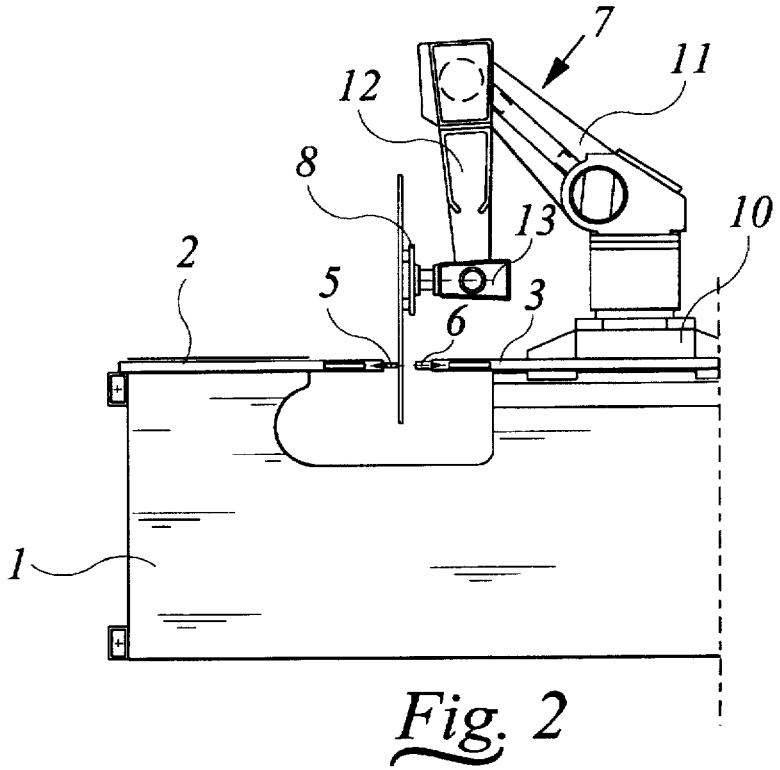

In the following the invention is described in detail with reference to the attached drawing, wherein FIG. 1 presents an embodiment of the folding press of the invention, schematically in front view;

FIG. 2 shows the section II—II from FIG. 1; and

Figure 3:
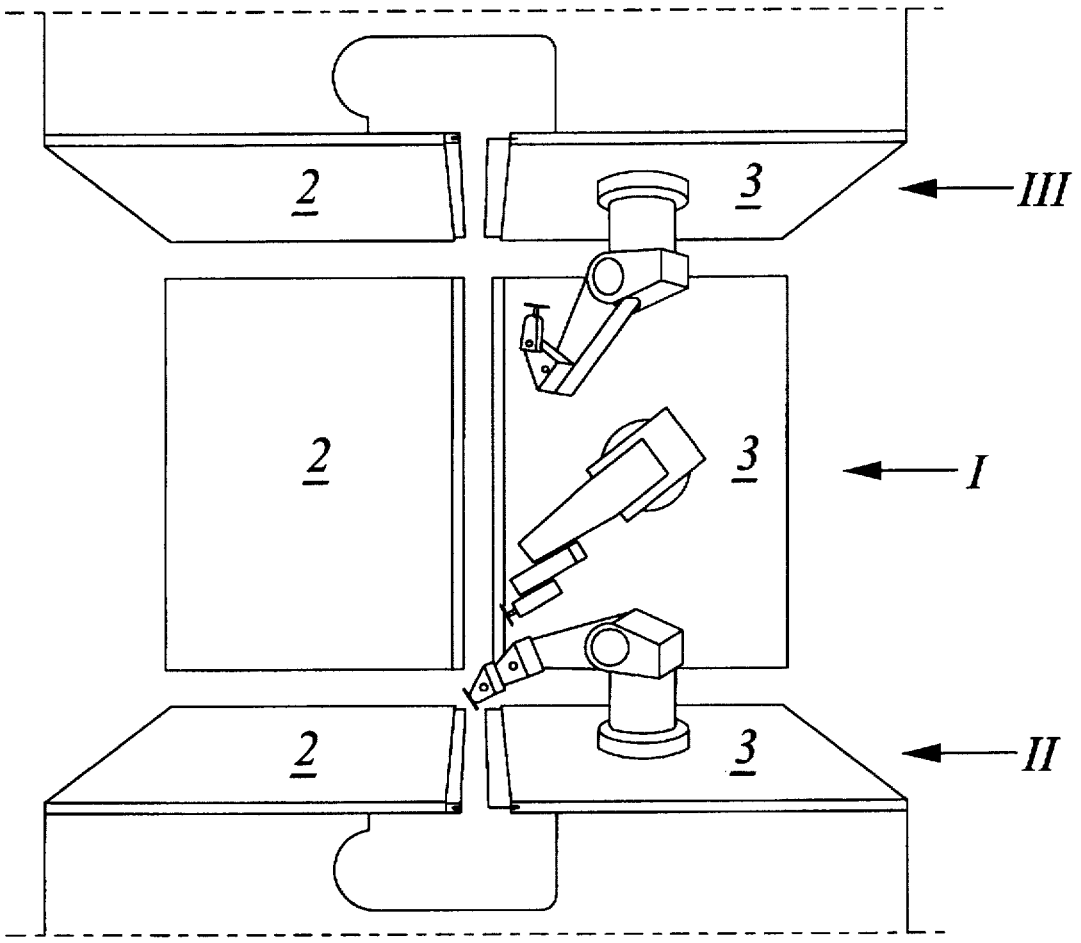

FIG. 3 presents, in perspective, three different alternative ways of mounting the folding press of the invention.

FIGS. 1 and 2 depict a folding press for folding pieces of sheet material. The press comprises a frame 1, carried on a fixed base, e.g. the floor of a mechanical workshop. A fixed beam 2 has been fixedly connected to the frame 1. The ram beam 3, in its turn, is carried on the frame 1 to be movable relative to the fixed beam. 2. The ram beam 3 is moved by means of a force member 4, disposed between the ram beam 3 and the frame 1 for moving the ram beam 3 relative to the fixed beam 2 in order to accomplish the folding working stroke. To the fixed beam 2 is attached an elongated, and beam-like, counterblade 5. In opposition to the counterblade, an elongated and beam-like thrust blade 6 is attached to the ram beam 3, parallelly relative to the counterblade 5. The counterblade 5 and thrust blade 6 constitute a pair of folding blades 5,6, the piece of metal sheet being foldable between them. The piece of sheet is handled with the aid of a multiple-articulated manipulation arm 7, which is for instance a programmable industrial robot or the like. The manipulation arm 7 comprises a stand 10, relative to which the manipulattion arm 7 is carried to be rotatable, and the stand 10 is connected to the ram beam 3. The robot comprises a multiple-articulated set of arms, comprising arms 11, end of the last arm 13 is provided a clamping member 8 for grasping the piece which is to be folded and for introducing it between the pair of folding blades 5,6 in predetermined manner.

The rigid, and slab-like, fixed beam 2 and ram beam 3 are in this example disposed in vertical position and side by side in the horizontal direction, the ram beam 3 is guided to be movable horizontally, and the force members 4 are arranged to produce the horizontal working stroke of the ram beam 3, whereby the piece of sheet to be folded can be folded in substantially vertical position between the counterblade 5 and the thrust blade 6.

In FIG. 1 is also seen a tool storage 9, belonging to the folding press, for thrust blades 6 and counterblades 5. The tool storage 9 has been disposed to be close to one end of the pair of folding blades 5,6. The tool storage is a revolving tool magazine. The tool storage 9 contains thrust blades and counterblades 5,6 in positions substantially parallelling their working position on the fixed and ram beams. The tool storage 9 is advantageously disposed within reach of the manipulation arm 7 so that exchange of thrust blades and counterblades can be made with the aid of the manipulation arm 7. In a vertical folding press the blades 5,6 can advantageously, utilizing the manipulation arm 7, be dropped directly from the tool magazine 9 downward into a respective fixing groove provided on the fixed and/or ram beam. If the blades are such which are assembled of pieces, identical or mutually different, such blade pieces may be dropped into their fixing grooves in succession according to the so-called pearl string principle. When the tool magazine is of the revolving type, the blade fixing groove on the fixed and/or ram beam and the corresponding groove in the tool magazine are brought into register so that, in a way, the fixing groove on the fixed or ram beam continues up into the tool magazine, and the tool magazine is merely rotated so as to present the proper continuation groove which holds the blade that is required. It is possible to select blades from the magazine for attachment both to the ram beam and to the fixed beam.

FIG. 3 shows three different modes of installing the folding press. Mode I is equivalent to the vertically positioned example of FIG. 1. The folding press may in addition be installed e.g. in accordance with installation modes II and III, in both of which the fixed beam 2 with its counterblade 5 and the ram beam 3 with its thrust blade 6 are substantially horizontally oriented. In installation mode II, the folding press is carried in horizontal position in the vicinity of the floor base of the building in which the folding press is installed, in horizontal position, the throat between the folding blades 5,6 opening upward. In installation mode III, the folding press is carried in horizontal position, in the height direction of the building in which the folding press is installed at a distance h from the plane of the floor base such that there remains free space below the folding press, in which case the throat between the folding blades opens downward. It is essential in all installation modes I–III that they enable the piece of sheet material which is to be folded to be kept vertical during the folding process. In addition to the embodiments presented here by way of example, the scope of the invention also encompasses the intermediate installation positions between vertical and horizontal, for instance also those positions in which the ram beam and horizontal beam are located in a plane which subtends an angle with the horizontal plane.

The invention is not exclusively delimited to concern the embodiment examples presented in the foregoing: numerous modifications are feasible within the scope of the inventive idea defined by the claims.

I claim:

1. A folding press comprising:

a frame adapted to be supported by a fixed base;

a fixed beam fixedly connected to said frame;

a ram beam carried on said frame and movable relative to said fixed beam;

a force member disposed between said ram beam and the frame for moving the ram beam relative to the fixed beam for producing a folding working stroke, said fixed beam and said ram beam are disposed side by side in a substantially horizontal direction relative to said fixed base, said ram beam is guided to move substantially in a horizontal direction relative to said fixed base and said force member produces a substantially horizontal working stroke of said ram beam;

a counterblade attached to said fixed beam;

a thrust blade attached to said ram beam in parallel to said counterblade, said counterblade and thrust blade forming a pair of folding blades for folding a sheet of material therebetween, said sheet of material being folded in a substantially vertical position relative to said fixed base between said counterblade and said thrust blade; and manipulation means comprising a clamping member for grasping the sheet to be folded and introducing it between said pair of folding blades, and a multiple-articulated robot manipulation arm attached to said clamping member having a plurality of consecutive arm members rotatable in relation to each other so that said sheet of material can be maintained in a substantially vertical position while being introduced by said clamping member between said pair of folding blades; and a stand relative to which said manipulation arm is carried to be rotatable, said stand being connected to the ram beam so that the stand and associated manipulation means moves with movement of the ram beam.

2. A folding press according to claim 1 further comprising a tool storage for storing said thrust blades and said counterblades.

3. A folding press according to claim 2 wherein said tool storage is disposed adjacent to one end of said pair of folding blades and said tool storage contains said thrust blades and counterblades in a substantially parallel position relative to their working position on said fixed and said ram beams.

4. A folding press according to claim 3 wherein said tool storage is a revolving tool magazine.

5. A folding press according to claim 1, wherein said fixed beam and said ram beam are disposed along a plane orientated substantially vertical to said fixed base.

6. A folding press according to claim 1, wherein said fixed beam and said ram beam are disposed along a plane orientated substantially horizontal to said fixed base.

* * * * *